United States Patent [19]

Miida et al.

[11] Patent Number: 4,833,636

[45] Date of Patent: May 23, 1989

[54] ANALOG, TWO SIGNAL CORRELATOR

[75] Inventors: Takashi Miida; Nozomu Ozaki, both of Kanagawa, Japan

[73] Assignee: Fuji Photo Film Co., Ltd., Kanagawa, Japan

[21] Appl. No.: 207,972

[22] Filed: Jun. 17, 1988

[30] Foreign Application Priority Data

Jun. 19, 1987 [JP] Japan ..... 62-151512

[51] Int. Cl.[4] ..... G06G 7/02

[52] U.S. Cl. ..... 364/819; 364/862; 357/24; 377/63

[58] Field of Search ..... 364/819, 824, 862, 825; 357/24; 328/167; 377/60, 62, 63

[56] References Cited

U.S. PATENT DOCUMENTS 4,034,199 7/1977 Lampe et al. ..... 364/862 X
4,041,298 8/1977 Lampe et al. ..... 364/862
4,079,238 3/1978 Lampe et al. ..... 364/862 X
4,509,181 4/1985 Sauer ..... 377/60 X
4,639,678 1/1987 Schlig et al. ..... 377/62 X

*Primary Examiner*—Joseph Ruggiero
*Assistant Examiner*—Charles B. Meyer
*Attorney, Agent, or Firm*—Sughrue, Mion, Zinn, Macpeak & Seas

[57] ABSTRACT

A correlator, such as may be used in a phase detecting device of an automatic focusing circuit for a camera , has a simple arrangement that attains improved accuracy and high speed. A pair of charge storing elements is provided to which input signals are applied. When predetermined charges are supplied into potential wells formed in the charge storing elements, charge remaining in the potential wells depending on their depth can be detected as the absolute value of the difference between the two input signals. Therefore, the input signals can be subjected to correlation directly as they are, that is, in analog form, without conversion to digital form.

3 Claims, 5 Drawing Sheets

ANALOG, TWO SIGNAL CORRELATOR

BACKGROUND OF THE INVENTION

The present invention relates to a correlator for calculating the correlation value of two signals. More particularly, the invention pertains to a correlator which performs arithmetic operations to obtain a correlation value in an analog signal processing mode.

The following equation is well known for calculating the correlation value of two signals:

$$H(l) = \sum_{k=1}^{n} |B(k) - R(k + l - 1)| \quad (1)$$

where B(k) and R(k+l−1) are the two signal trains upon which the calculation is carried out.

The difference of the two signals is obtained for each value of the variable k, and the sum of the absolute values of the differences is determined to calculate the correlation H(l) of the two signals. The variable l indicates the relative movement (deviation) between the two signals. For each value of the variable l, the operation is repeated for k=1 to n, whereby correlation value patterns H(1), H(2), . . . , H(l) are obtained. The phase difference between the two signals can be detected from changes in the correlation value patterns H(1), H(2), . . . , H(l).

Such a method has been extensively employed in the field of signal processing. An example of an application of such signal processing is in detecting the point of correct focus for a camera. A conventional correlator applied to a phase difference detecting device as shown in FIG. 6 will now be described.

As shown in FIG. 6, a film plane 2 is located behind the photographing lens 2 of a camera, and a condenser lens 3, separator lens 4, and a phase difference detecting device are arranged behind the film plane 2 in the stated order. The phase difference detecting device may be implemented with line sensors 5 and 6, such as CCDs (Charged-Coupled Devices) for photoelectrically converting a pair of images of the object formed by the separator lens 4. The phase difference detecting device further includes a correlator for determining from the electrical signals produced by the line sensors 5 and 6, which are related to the distribution of luminous intensity, whether or not the photographing lens is properly focused on the object.

In a "front focus" condition in which the image is positioned in front of the film plane, the images on the line sensors 5 and 6 are near the optical axis, in a "rear focus" condition in which the image is located behind the film plane the images on the line sensors 5 and 6 move away from the optical axis, and in the properly focused condition the images on the line sensors 5 and 6 are located between their respective positions for the "front focus" and "rear focus" conditions, that is, at the focusing position. Therefore, the focusing condition at any time can be determined by detecting the positions of the images with respect to the optical axis 8 from the electrical signals produced by the line sensors 5 and 6.

A correlation operation based upon equation (1) above has been employed for the automatic detection of the positions of the images on the lines sensors 5 and 6. That is, the correlation value of one pair of images formed on the line sensors 5 and 6 are calculated from equation (1), and when the correlation value is a maximum (or minimum), the amount of relative movement l is detected to thereby determine the positional deviation (focusing condition) of the two signals B(k) and R(k+l−1).

In equation (1), B(k) corresponds to the electrical signals produced by the picture elements of the line sensor 5, R(k+l−1) corresponds to the electrical signals provided by the picture elements of the line sensor 6, and k indicates the arrangement of the picture elements. As the variable l is changed within a range of unity to a given value, equation (1) is evaluated with respect to the signals B(k) and R(k+l−1). As a result, a correlation value pattern H(1), H(2), . . . H(l), as indicated in FIG. 8, is obtained.

It is determined in advance that, for example, the photographing lens is properly focused on the object when the correlation value H(4) is a maximum. Therefore, when a correlation value other than H(4) is a maximum, it is determined that the photographing lens is defocused, with the amount of defocusing being indicated by the phase difference from the case of l=4.

The arrangement of a conventional correlator operating as described above is shown in FIG. 7. Analog electrical signals produced by the picture elements of the line sensors 5 and 6 are converted by an A/D (analog-to-digital) converter 9 into, for instance, eight-bit digital data, which is stored in a RAM (random access memory) 11 under the control of a microcomputer (CPU - central processing unit) 10. That is, evaluation of equation (1) is carried out employing digital data stored in the RAM.

In this conventional correlator, however, because the correlation values are calculated in a digital mode, the conventional correlator is disadvantageous in that it requires the provision of an expensive A/D converter in order to be able to carry out the required calculations at high speed with the required accuracy. Furthermore, the conventional correlator is disadvantageous in that rounding errors occur due to limitations, for example, in the number of bits handled by the microprocessor, thus lowering the accuracy of the calculation. Moreover, the computer requires a complex and expensive program to perform the required operations.

SUMMARY OF THE INVENTION

Accordingly, it is an object of the invention to provide a correlator in which the above-discussed drawbacks and disadvantages have been eliminated.

More specifically, it is an object of the invention to provide a correlator which can calculate the correlation value of the input signals at a high speed and with a high accuracy, yet which has a simple construction so that it can be constructed on a single IC chip or integrated circuit device.

The foregoing and other objects of the invention have been achieved by the provision of a correlator for obtaining as a correlation value the sum of the absolute values of the difference between pairs of input signals to be operated upon, which, according to the invention, includes: input sources having potential wells which change in depth in accordance with the voltages applied thereto; a first charge storing element having a potential well whose depth changes with a voltage applied to a gate layer thereof and which is juxtaposed with one of the input sources so that electrical charges are transmitted between the first charge storing element and that input source; a second charge storing element having a potential well whose depth changes with a voltage applied to a gate layer thereof and which is juxtaposed with the first charge storing element in such a manner that electrical charge is transmitted between the potential well of the first charge storing element and the potential well of the second charge storing element; a third charge storing element having a potential well whose depth changes with a voltage applied to a gate layer thereof and which is juxtaposed with the other input source so that electrical charges are transmitted between the third charge storing element and the input source with respect to the Fermi level thereof; a fourth charge storing element having a potential well whose depth changes with a voltage applied to a gate layer thereof and which is juxtaposed with the third charge storing element in such a manner that electrical charge is transmitted between the potential well of the third charge storing element and the potential well of the fourth charge storing element; and floating diffusions forming potential wells for storing charges transmitted from the potential wells of the second and fourth charge storing elements, and in which, after one of the input signals is applied to the gate layers of the first and third charge storing elements and the other input signal is applied to the gate layers of the second and fourth charge storing elements, the Fermi levels of the input sources are temporarily made smaller than the depths of the potential wells of the first through fourth charge storing elements so that charge stored in advance is transferred into the potential wells of the first through fourth charge storing elements, and charge remaining in the potential well of the second or fourth charge storing element is accumulated, as the absolute value of the difference between the input signals, in one of the floating diffusions.

A specific feature of the invention resides in that the variations of the depths of the potential wells of the first through fourth charge storing elements are utilized to obtain the absolute value of the difference between the input signals in an analog processing mode.

DESCRIPTION OF THE PREFERRED EMBODIMENTS

An example of a correlator constructed in accordance with the present invention will now be described with reference to the accompanying drawings.

Figure 1:
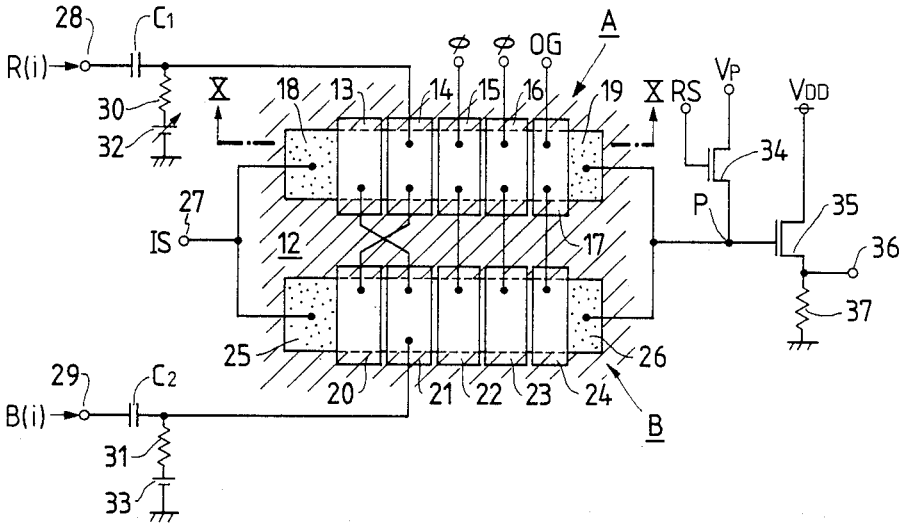
FIG. 1 is a top view showing an example of a phase difference detecting device constructed according to the invention.
Figure 2:
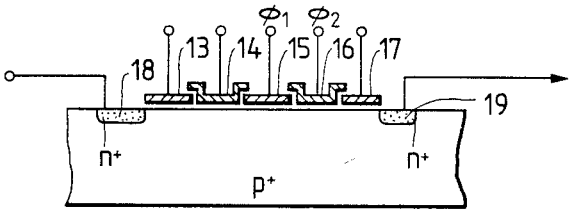
FIG. 2 is a sectional view taken along a line X—X in FIG. 1.

First, the general arrangement of the inventive correlator will be described with reference to FIGS. 1 and 2. FIG. 1 is a top view showing the overall construction of the correlator embodied in the form of a semiconductor integrated circuit, and FIG. 2 is a sectional view taken along a line X—X in FIG. 1. In FIG. 1, the shading indicates an isolation region formed on the surface of the semiconductor substrate. The isolation region 12 electrically separates a pair of arithmetic regions A and B from one another.

The first arithmetic region A has gate layers 13, 14, 15, 16 and 17 which are formed through a gate oxide film layer (not shown) on the semiconductor substrate and are arranged longitudinally with an input source 8 and a floating diffusion 19 at the two respective ends. The gate layers are made, for instance, of polysilicon. As shown in FIG. 2, the gate layers 13 through 17 overlap one another with small gaps therebetween. The input source 18 and the floating diffusion 19 are formed in an $n^+$ type impurity layer formed on the upper surface of the p type semiconductor substrate.

The second arithmetic region B is similar in construction to the first arithmetic region A. That is, the second arithmetic region B has gate layers 20 through 24 which correspond to the gate layers 13 through 17, respectively, of the first arithmetic region A, and an input source 25 and a floating diffusion 26 which correspond, respectively, to the input source 18 and the floating diffusion 19 of the first arithmetic region A.

The input sources 18 and 25 are connected to a control terminal 27 through lead wires formed by vacuum deposition of aluminum and to which a preset signal IS (described below in detail) is applied.

The gate layers 13 and 21 are connected to each other through a vacuum-deposited aluminum or polysilicon lead wire, and the gate layers 14 and 20 are connected to each other in the same manner. The gate layers 14 and 20 are connected through a capacitive element $C_1$ to a first input terminal 28, whereas the gate layers 13 and 21 are connected through a capacitive element $C_2$ to a second input terminal 29. The output-side terminal of the capacitive element $C_1$ is connected to a DC bias circuit composed of a resistor 30 and a reference voltage source 33. Offset adjustment can be achieved by changing the voltage of the reference voltage source 32. The input signals upon which the calculations are to be performed, that is, the input signals in equation (1) above, are applied to the input terminals 28 and 29, as will be described below in more detail.

The gate layers 15 and 22 are connected to each other, as are the gate layers 16 and 23 and the gate layers 17 and 24. A gate drive signal $\phi_1$ is applied to the gate layers 15 and 22, a gate drive signal $\phi_2$ is applied to the gate layers 16 and 23, while an output gate voltage VOG is applied to the gate layers 17 and 24, so that, in response to the voltages of the signals $\phi_1$, $\phi_2$ and OG, potential wells are formed below the gate layers 15 through 17 and 22 through 24 which result in the transfer of charge. That is, effectively a charge-coupled device is formed.

The floating diffusions 19 and 26 are connected through vacuum-deposited aluminum lead wires to a common connecting point P, which in turn is connected to a MOS transistor 34 forming a reset circuit and are also connected to an output terminal 36 through a MOS transistor 35 forming a source follower circuit. That is, the drain of the MOS transistor 34 is connected to the common connecting point P so that, when, with a reset voltage $V_p$ applied to the source of the MOS transistor 34 so that the transistor 34 is rendered conductive by the reset signal RS applied to the gate, the reset voltage $V_p$ is applied to the floating diffusions 19 and 26. The source of the transistor 35 is connected to a power source $V_{DD}$, and the drain thereof is grounded through a resistor 37 and connected to the output terminal 36.

The operation of the correlator thus constructed will now be described with reference to FIGS. 3 through 5.

Figure 7:
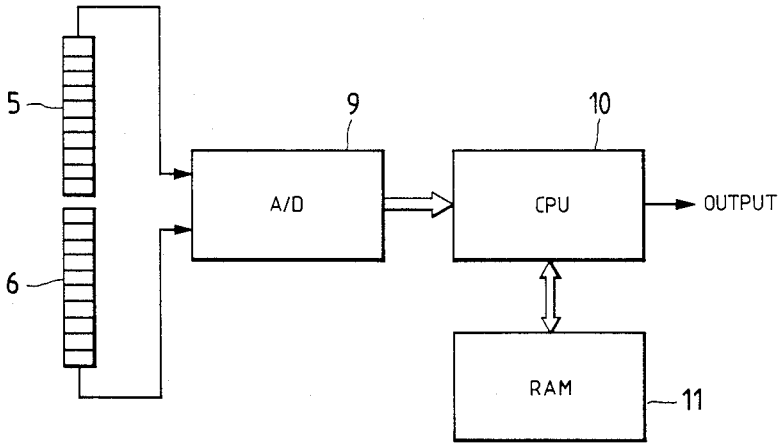
FIG. 7 is a block diagram showing the arrangement of the conventional phase difference detecting device.
Figure 8:
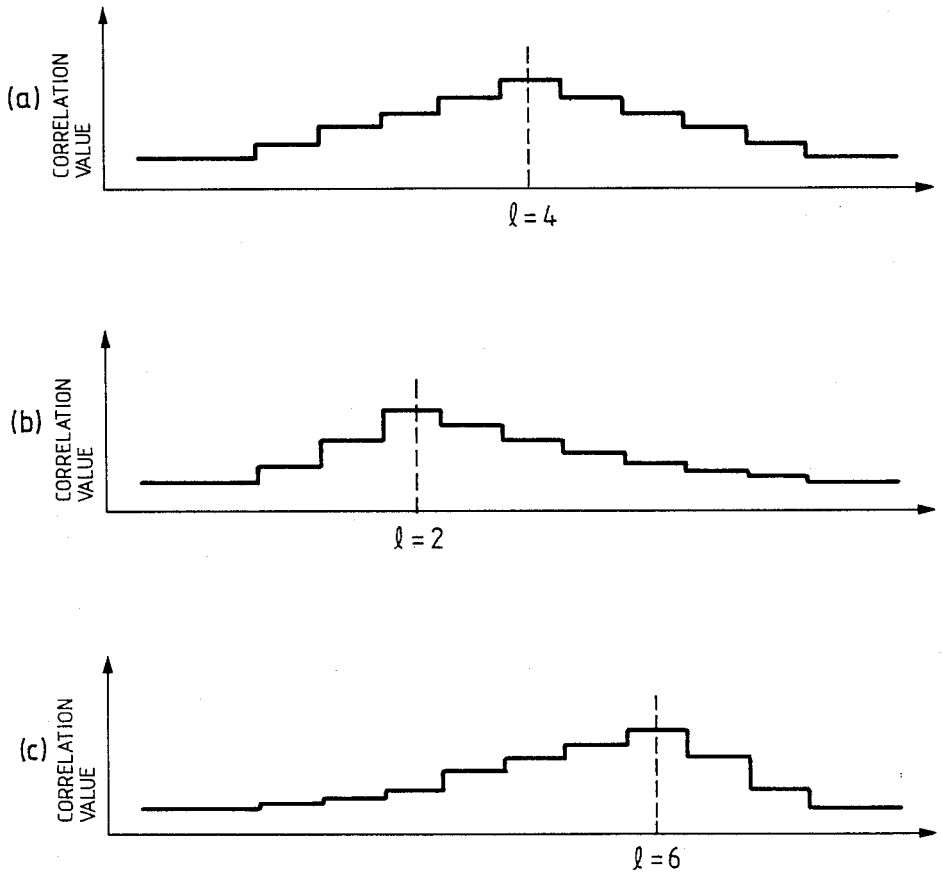
FIG. 8 is an explanatory diagram for a description of the principles of detecting a focused condition in the automatic focus detecting device of FIG. 6.

One of the input signals upon which the calculations are to be performed is applied to the first input terminal 28, while the second input signal is applied to the second terminal 29. These input signals are supplied with a predetermined timing. For instance, in the above-discussed camera phase difference detecting application, the signals produced by the line sensor 5 (FIG. 7) are successively supplied to the input terminal 28 with a predetermined timing, while the signal produced by the line sensor 6 are successively supplied to the input terminal 29 with the same timing. In the case of the invention, these signals can be supplied directly without modification, that is, as analog signals. For convenience in the following description, the two input signals supplied with the predetermined timing are designated by R(i) and B(i).

Figure 3:
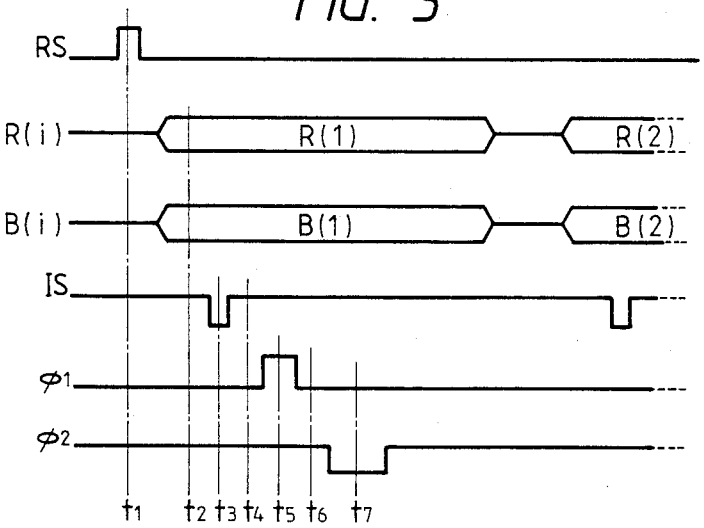
FIG. 3 is a timing chart for a description of the operation of the device shown in FIG. 1.

FIG. 3 is a timing chart showing the control signals IS, RS, $\phi_1$, $\phi_2$ and OG used in the calculation operations. FIG. 4 shows potential profiles of the first arithmetic region A at time instants $t_1$ through $t_7$, and FIG. 5 similarly shows potential profiles of the second arithmetic region A at the same time instants $t_1$ through $t_7$.

In operation, the reset signal is raised to the "H" level for a predetermined period of time (the time instant $t_1$) to thereby render conductive the MOS transistor 34, thus applying the potential $V_p$ to the floating diffusions 19 and 26. As a result, potential wells 19*a* and 26*a* of a predetermined depth are formed below the floating diffusions 19 and 26, as shown in FIGS. 4 and 5, respectively. Next, the first pair of input signals R(1) and B(1) are applied to their respective input terminals 28 and 29. As a result, as shown at (a) in FIG. 4 and (a) in FIG. 5, potential wells 13*a*, 14*a*, 20*a* and 21*a* having depths corresponding to the voltage levels of the signals R(1) and B(1) are formed below the respective gate layers 13, 14, 20 and 21. When R(1)>B(1), the potential wells 14*a* and 20*a* are deeper than the potential wells 13*a* and 21*a*, as is illustrated.

Next, the preset signal IS is set to the "L" level for a predetermined period of time so that the potential wells 18*a* and 25*a* below the floating diffusions 18 and 25 are reduced in depth, whereby the charges stored in the potential wells 18*a* and 25*a* are allowed to flow to the potential wells 13*a* and 14*a* and to the potential wells 20*a* and 21*a*, respectively, as indicated by arrows at (b) in FIGS. 4 and 5, at the time instant $t_3$. Thereafter, the preset signal IS is raised to the "H" level again, as a result of which the potential wells 18*a* and 25*a* are made deeper at the time instant $t_4$. As a result of this series of operations, a charge q(1) corresponding to the difference in depth between the potential wells 13*a* and 14*a* remains in the potential well 14*a* in the arithmetic region A, and all the charge in the potential wells 20*a* and 21*a* in the arithmetic region B returns to the potential well 25*a*. Since the depths of the potential wells 13*a* and 14*a* are proportional to the voltages of the input signals R(1) and B(1), the charge q(1) remaining in the potential well 14*a* is proportional to the absolute value of the difference between the signals R(1) and B(1).

When the gate drive signal $\phi_1$ is subsequently raised to the "H" level at the time instant $t_5$, as shown at (c) in FIGS. 4 and 5, the potential wells 15*a* and 22*a* below the gate layers 15 and 22 are increased in depth so that the charge q(1) in the potential well 14*a* is transferred into the potential well 16*a* below the gate layer 16. In this case, since no charge to be transferred is present in the second arithmetic region B, the potential well 23*a* is empty, as shown at (c) in FIG. 5.

Figure 4:
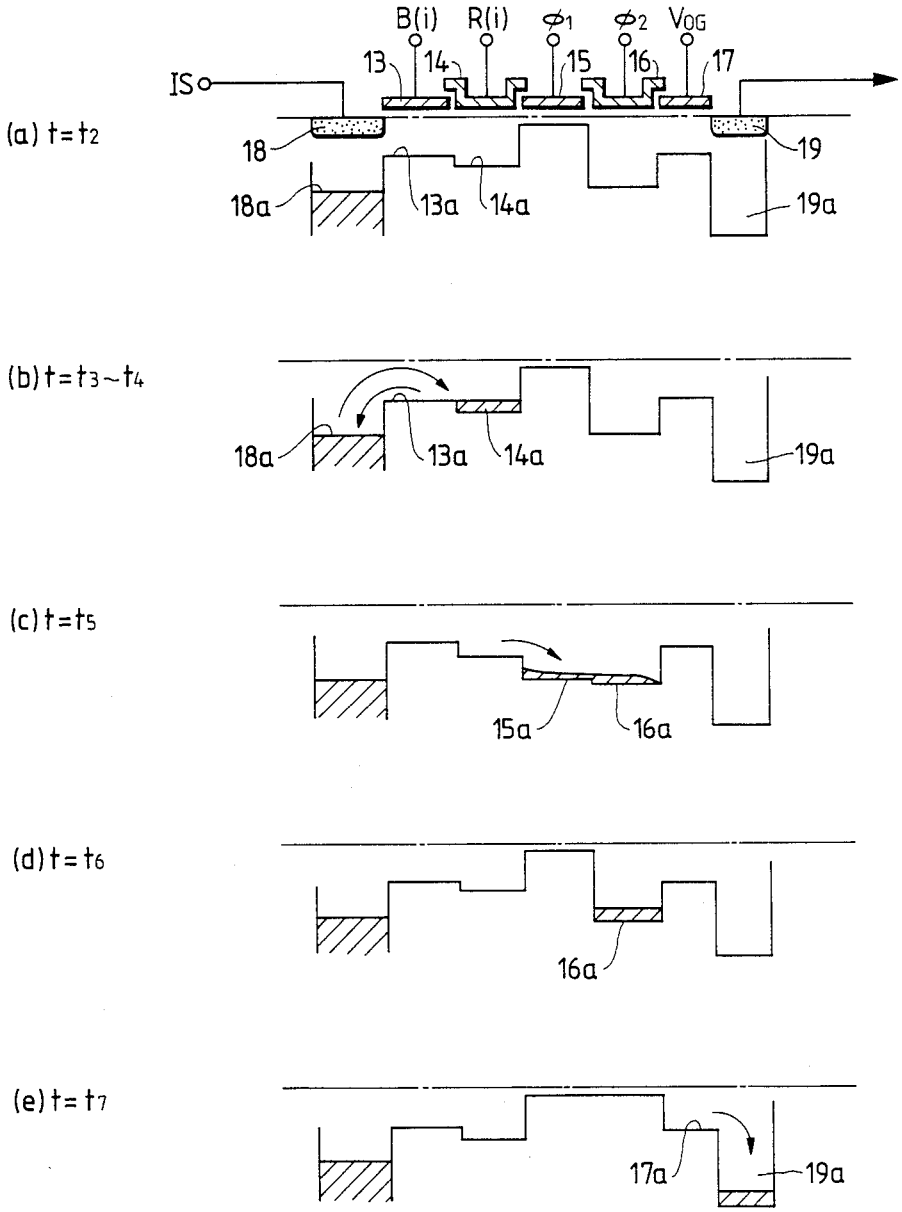
FIG. 4 is a diagram showing potential profiles in correspondence to the timing chart of FIG. 3 for a description of the operation of a first arithmetic region in FIG. 1.
Figure 5:
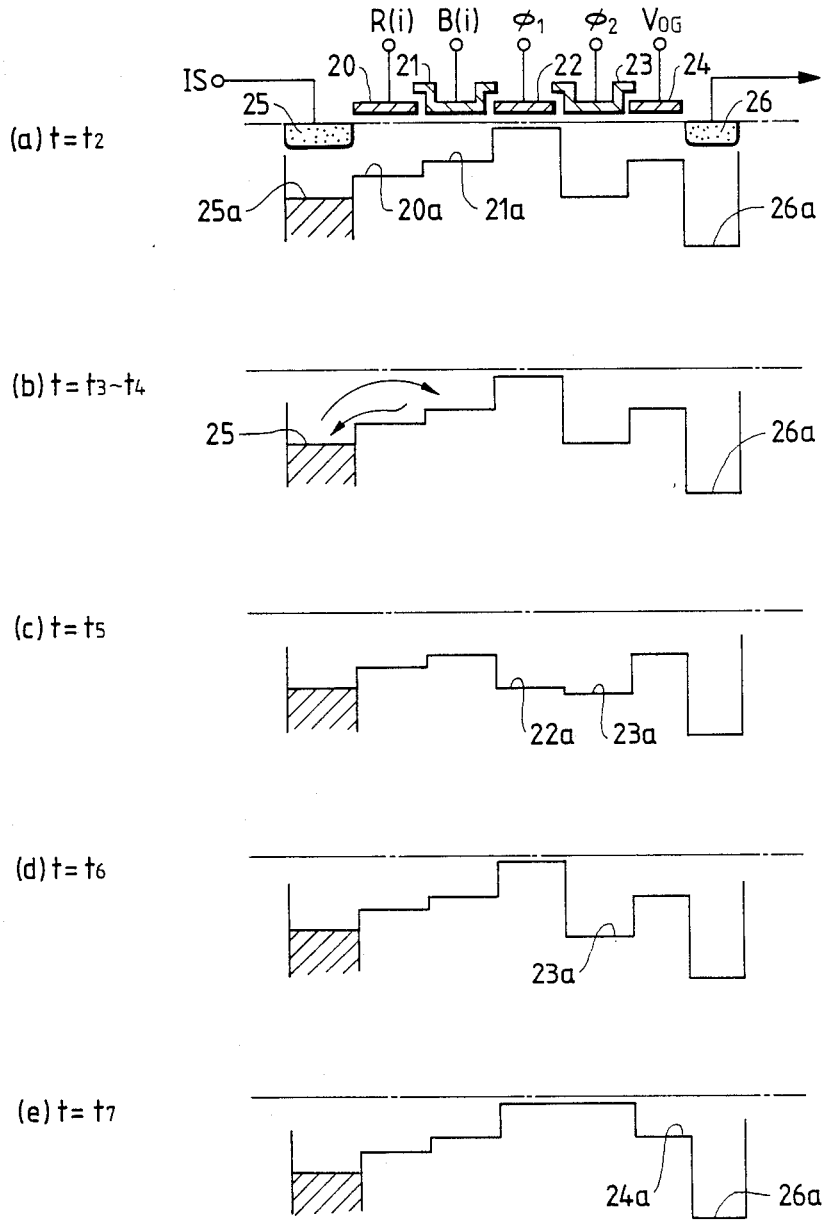
FIG. 5 is a diagram showing potential profiles in correspondence to the timing chart of FIG. 3 for a description of the operation of a second arithmetic region in FIG. 1.
Figure 6:
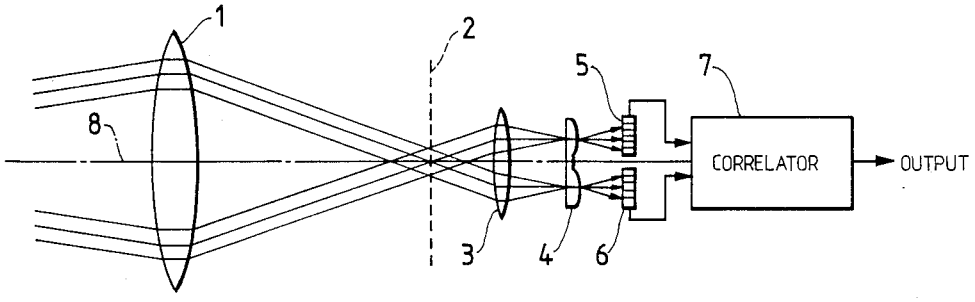
FIG. 6 is a block diagram showing a conventional phase difference detecting device applied in an automatic focus detecting device for a camera.

When the gate drive signal $\phi_1$ is set to the "L" level as shown at (e) in FIGS. 4 and 5, the charge q(1) is transferred into the potential well 19A. Thereafter, the voltage levels of the control signals IS, $\phi_1$ and $\phi_2$ are restored to those at the time instant $t_2$ so that the potential wells 15*a* and 22*a* are reduced in depth. As a result, the charge q(1) is held in the potential well 19*a* and no charge is transferred into the potential well 26*a*.

FIGS. 4 and 5 as discussed above illustrate the case where R(1)>B(1). On the other hand, for R(1)<B(1), the potential profiles of FIG. 4 correspond to the second arithmetic region B and those of FIG. 5 to the first arithmetic region A. Therefore, in the case of R(1)<B(1), a charge q'(1) proportional to B(1)−R(1) is transferred into the second potential well 26*a*, and no charge is transferred into the potential well 19*a*.

With respect to the next input signal pair R(2) and B(2), the same operations described above are carried out. That is, a charge proportional to the absolute value |R(2)−B(2)|, in addition to the previous charge q(1) or q'(1), is held in the potential well 19*a* or 26*a*. The reset signal RS is raised to the "H" level only at the operation start time instant $t_1$, and it is held at the "L" level until the correlation calculation operations for a predetermined number of input signal pairs have been executed. Therefore, the potentials of the floating diffusions 19 and 26 increase with the charges held in the potential wells 19*a* and 26*a*.

The above-described operations are carried out for a predetermined number n of signals R(1) through R(n) and B(1) through B(n). After that, the total charge Q(1) held in the potential wells 19*a* and 26*a* is:

$$Q(1) = \sum_{i=1}^{n} |B(i) - R(i)| \tag{2}$$

A voltage proportional to the charge Q(1) is produced at the common connected point P in FIG. 1, and is provided at the output terminal 36 through the MOS transistor 35 forming the source follower circuit. This voltage is equal to the correlation value H(1) for l=1 in equation (1) above.

The same operation is carried out with the input signals R(i) and B(i) shifted by one unit. Then, the charge Q(2) held in the potential wells 19*a* and 26*a* is:

$$Q(2) = \sum_{i=1}^{n} |B(i) - R(i + l - 1)| \tag{3}$$

Thus, the charge Q(2) is equal to the correlation value H(2) obtained in the case of l=2 in equation (1).

Therefore, by carrying out the same operations repeatedly while shifting the two input signals relative to one another successively, $$Q(l) = \sum_{i=1}^{n} |B(i) - R(i + l - 1)| \quad (4)$$

Thus, the pattern of correlation values represented by equation (1) is obtained on the output terminal 36.

As is apparent from the above description, the correlator of the invention, having a very simple arrangement, can nevertheless accurately calculate correlation value patterns. Furthermore, the correlator of the invention, unlike the conventional case, does not require the conversion of the input signals to digital form, and does not require separate calculation of the individual differences and absolute values. As a result, the correlator of the invention is able to attain a high processing speed and wide dynamic range. By forming the correlator as a single integrated circuit device, the first and second arithmetic regions can be accurately matched with one another, thus providing the calculator with a high accuracy.

Although the inventive correlator is readily adapted for use in a phase detecting device use for automatic focus detection for a camera, the invention is certainly not limited to such an application. That is, the correlator of the invention can be extensively employed for detecting correlation values.

As described above, in the correlator of the present invention having one pair of charge storing elements to which input signals are applied, when predetermined charges are supplied into potential wells formed in the charge storing elements, charge remaining in the potential well depending on its depth can be detected as the absolute value of the difference between the two input signals. Therefore, the input signals can be subjected to correlation directly as they are, that is, in analog form, without conversion to digital form. As a result, the correlator of the invention achieves a high operating speed and improved accuracy, while having a very simple arrangement.

What is claimed is:

1. A correlator for obtaining as a correlation value the sum of the absolute values of the difference between pairs of input signals to be operated upon comprising:

a pair of input sources having potential wells, where said potential wells of said pair of input sources change in depth in accordance with voltages applied to said potential wells;

a first charge storing element having a potential well, where the depth of said potential well of said first charge storing element changes in accordance with a voltage applied to a gate layer of said potential well of said first charge storing element, and where said first charge storing element is juxtaposed with one of said input sources so that electrical charges are transmitted between said first charge storing element and said one of said input sources;

a second charge storing element having a potential well, where the depth of said potential well of said second charge storing element changes in accordance with a voltage applied to a gate layer of said potential well of said second charge storing element, and where said second charge storing element is juxtaposed with said first charge storing element so that a electrical charge is transmitted between said potential well of said first charge storing element and said potential well of said second charge storing element;

a third charge storing element having a potential well, where the depth of said potential well of said third charge storing element changes in accordance with a voltage applied to a gate layer of said potential well of said third charge storing element, and where said third charge storing element is juxtaposed with the other of said input sources so that electrical charges are transmitted between said potential well of said third charge storing element and said other of said input sources with respect to a Fermi level of said other of said input sources;

a fourth charge storing element having a potential well, where the depth of said potential well of said fourth charge storing element changes in accordance with a voltage applied to a gate layer of said potential well of said fourth charge storing element, and where said fourth charge storing element is juxtaposed with said third charge storing element so that a electrical charge is transmitted between said potential well of said third charge storing element and said potential well of said fourth charge storing element;

a pair of floating diffusions forming potential wells for storing charges transmitted form said potential wells of said second and fourth charge storing elements, and in which, after one of said input signals is applied to said gate layer of said second and fourth charge storing elements, Fermi levels of said input sources are temporarily made smaller than the depths of said potential wells of said first through fourth charge storing elements so that charge stored in advance is transferred into said potential wells of said first through fourth charge storing elements, and charge remaining in said potential wells of said second or fourth charge storing element is accumulated, as an absolute value of the difference between said input signals, in one of said floating diffusions.

2. The correlator of claim 1, wherein all of said input sources and first through fourth charge storing elements are formed on a single semiconductor substrate as a semiconductor integrated circuit.

3. The correlator of claim 1, wherein said gate layers of said first and third charge storing elements are connected together and said gate layers of said second and fourth charge storing elements are connected together.

* * * * *